United States Patent [19]

Cokefair

[11] Patent Number: 4,520,290

[45] Date of Patent: May 28, 1985

[54] GAS DISCHARGE DISPLAY WITH BUILT-IN HEATER

[75] Inventor: Jon Cokefair, Waukegan, Ill.

[73] Assignee: Cherry Electrical Products Corporation, Waukegan, Ill.

[21] Appl. No.: 437,557

[22] Filed: Oct. 29, 1982

[51] Int. Cl.[3] ..... H01J 1/22; H01J 61/60

[52] U.S. Cl. ..... 313/15; 313/582; 313/583; 313/584

[58] Field of Search ..... 313/15, 16, 37, 514, 313/517, 518, 519, 520, 521, 484, 491, 492, 631, 632, 634, 635, 582, 585, 586, 583, 584, 587; 315/169.4; 340/713, 714; 350/331 T

[56] References Cited

U.S. PATENT DOCUMENTS

| | | | |
|---|---|---|---|
| 1,839,502 | 1/1932 | Rudenberg et al. | 313/16 |
| 2,581,959 | 1/1952 | Koehler | 315/100 |
| 3,177,345 | 4/1965 | Plumat | 219/543 |
| 4,147,947 | 4/1979 | Hoeh | 313/27 |
| 4,156,164 | 5/1979 | Yamagami et al. | 315/169.4 |

FOREIGN PATENT DOCUMENTS

| | | | |
|---|---|---|---|
| 2932252 | 2/1981 | Fed. Rep. of Germany | 340/713 |
| 122138 | 9/1979 | Japan | 340/713 |

OTHER PUBLICATIONS

Research Disclosure No. 16387, Nov. 1977, disclosed anonymously.

*Primary Examiner*—David K. Moore
*Assistant Examiner*—K. Wieder
*Attorney, Agent, or Firm*—Willian Brinks Olds Hofer Gilson & Lione Ltd.

[57] ABSTRACT

A gas discharge display has been disclosed in which a heater has been built into the unit. A single set of parallel conductive pins provide the connections for the unit's anode, cathode and heater strip.

7 Claims, 4 Drawing Figures

FIG. 1
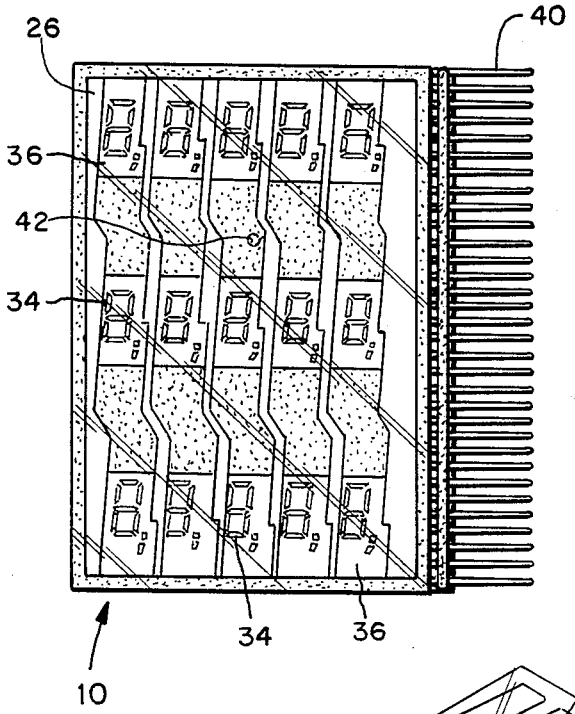
FIG. 2
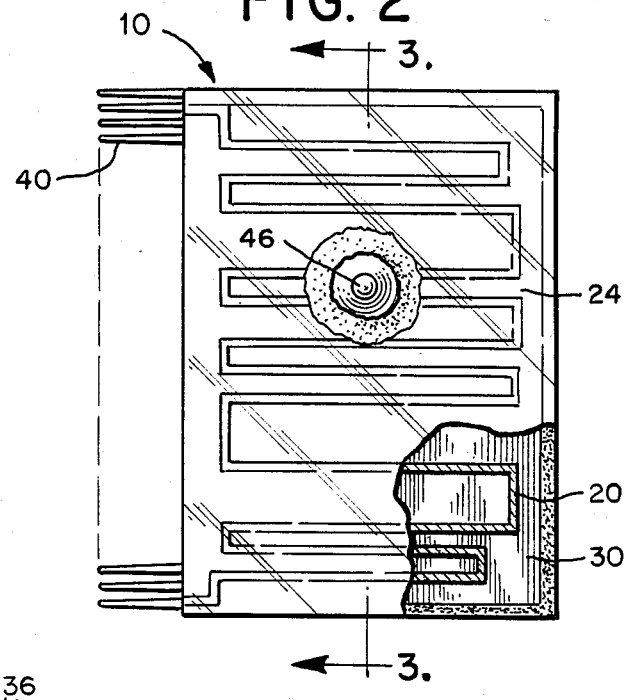
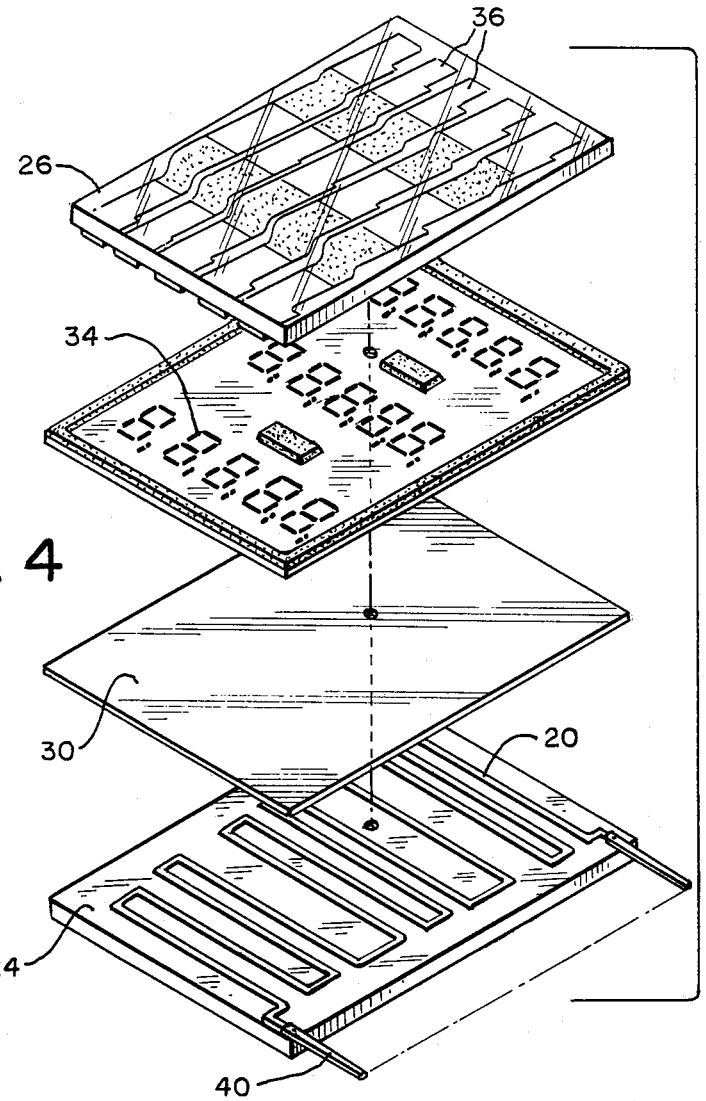
FIG. 4
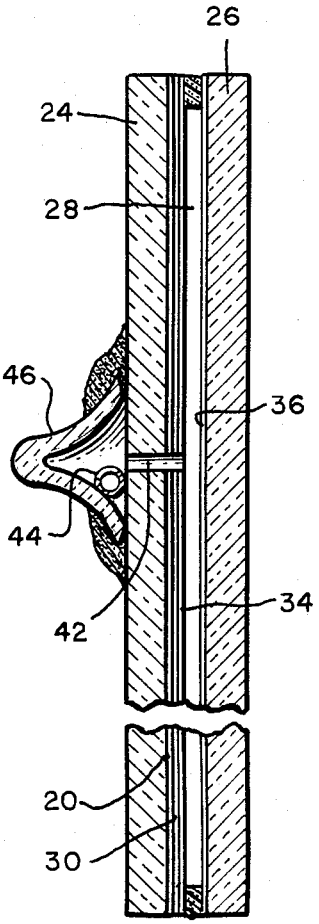
FIG. 3

GAS DISCHARGE DISPLAY WITH BUILT-IN HEATER

BACKGROUND OF THE INVENTION

This invention relates to gas discharge displays. More particularly, it relates to alpha-numeric gas discharge displays used in locations exposed to cold temperatures, for example, in gasoline pumps.

A gas discharge display includes a chamber in which is sealed a mixture of inert gases, such as neon and argon, at subatmospheric pressures. Mercury vapor is included within this chamber to impede ions from bombarding the cathode while the display is on. Mercury vapor condenses at about 0° C. inside the sealed subatmospheric chamber. So in applications where the gas discharge display is cooled to temperatures at or below 0° C., condensed mercury will settle onto the cathode. During the operation of the display, the display itself usually produces enough heat to keep the mercury vaporized. Condensation will occur when the display is turned off in a cold environment. The condensed mercury on the cathode surface creates a lump on the surface which decreases the distance between the anode and cathode at that spot. This will cause more current to flow through that spot and will appear as a bright spot in the display. These lumps are called hot spots. The increased current flow through a hot spot can cause the mercury to splatter through the chamber. Mercury settling on the anode blocks the view through the anode creating a black spot in the display.

It is possible for solidification of mercury on the cathode to cause even greater problems. A large build-up of mercury could cause an arc discharge rather than the normal glow discharge. An arc discharge can cause damage to the display surface through the splattering of mercury and the more intense heat. Another problem caused by the condensation of mercury is that there will be less mercury vapor in the chamber to hinder the ion bombardment of the cathode. The increased bombardment will decrease the life span of the cathode, thereby reducing the useful life of the display. To eliminate these problems, it is therefore desirable to heat the gas discharge display prior to turning it on when the ambient temperature is below the condensation point of the mercury.

Where these problems have been recognized, it has been the general practice to include a heating unit behind the display. The heating unit would be separately connected to a power source. In cold weather, prior to switching on the gas discharge display the heating unit is turned on. Problems may be caused if such a separate heating unit is exposed to an adverse environment. For instance, moisture in the air can corrode or rust the heater unit. Condensation of moisture against the glass of the display may cause further problems, such as cracking of the glass. Also, where the gas discharge display is used in a gasoline pump, exposure to gasoline fumes would be undesirable for the heater unit because of the high temperatures and possibility of arcing.

It is the object of the present invention to provide a gas discharge display with a built-in heater. Since the heater will be within the display unit, the resulting product will be more economical, more efficient and easier to connect to a power source.

SUMMARY OF THE INVENTION

This invention is directed to a gas discharge display unit with a built-in heater. A sealed gas chamber is formed between two layers of glass. The anode and cathode terminals are on opposite sides of the chamber. A heater strip is located within the glass layers behind the cathode terminal. The heater strip is electrically insulated from the cathode. External electrical connections are provided to the terminals and the heater strip.

According to the preferred embodiment of the invention, the electrically conductive connector pins for the terminals and the heater strips are lined up in parallel along one edge of the display unit. This provides the advantage of easy connection to a power source for the control of the display and the heater. Because of the proximity of the heater strip to the cathode terminal, the heating of the terminal and the gas chamber is more efficient than if the heater were external to the unit. A further advantage is the economy of manufacturing a display with the heater in a single unit rather than separately building and selling the display and heater.

Other objects and advantages of the invention will become apparent during the following description of the presently preferred embodiments of the invention taken in conjunction with the drawings.

BRIEF DESCRIPTION OF THE DRAWINGS

FIG. 1 is a front view of a gas discharge display with built-in heater of the present invention.

FIG. 2 is a rear view of the gas discharge display of FIG. 1.

FIG. 3 is a side view of the gas discharge display of FIG. 1.

FIG. 4 is an exploded view of the gas discharge display of FIG. 1.

DETAILED DESCRIPTION OF THE PREFERRED EMBODIMENT

Referring now to the FIGS. 1 through 4, the present invention includes a heater strip 20 within the gas discharge display unit 10. Two layers of glass 24, 26 are sealed together to form a gas chamber 28. The heater strip 20 is screened onto the inside face of the first layer of glass 24. A dielectric layer of glass 30 overlies the heater strip 20. The dielectric layer 30 electrically insulates the heater strip 20 so that a cathode terminal 34 can be screened over the dielectric layer 30 without creating an interference with the heater. Opposite the cathode terminal 34 within the chamber 28 is an anode terminal 36 which is screened onto the second layer of glass 26. A series of electrically conductive connector pins 40 are connected in parallel along one edge of the display unit. The connector pins 40 plug into an electronic controller for controlling the terminals and the heater strip.

The cathode terminal 34 displays alpha-numeric images by selectively activating terminal segments. In FIG. 1, the cathode is shown in the shape of a figure 8 having seven separate segments. This cathode configuration can take the form of any of the 10 numerical digits. Other configurations may be used so that the alphabet or other images may be displayed on the unit.

The heater strip 20 is separated from the cathode 34 only by the dielectric layer 30. The resulting proximity of the heater strip 20 to the cathode allows for efficiently heating the cathode 34 and the chamber 28.

The manufacture of a gas discharge display of the present invention begins by drilling a tiny hole 42 through the first layer of glass 24. The hole 42 will be used later in the manufacturing process for providing access to the sealed chamber 28.

Layers of conductive and insulating material are screened printed onto the layers of glass. The glass may be made from ordinary soda lime window glass. Any type of clear glass may be used in the gas discharge display. The heater strip 20 is screen printed onto the first layer of glass 24. Preferably, a nickel thick film material is used for this strip. The strip 20 is laid out on the layer of glass 24 so that most of the heat will be generated directly behind the cathode terminal segments. The strip extends to the edge of the display unit for making electrical contact with the connector pins 40.

Means for electrically insulating the heater strip 20 from the cathode terminal 34 must be placed over the heater strip 20. A layer of dielectric material 30 serves as the insulation. Preferably, insulating glass is used as the dielectric material. The insulating glass is dyed black to avoid distracting from the visual display. The cathode terminal 34 is screened over the dielectric layer 30. This layer is also preferably made from the nickel thick film material. The cathode terminal 34 is laid out in a configuration which allows production of the desired display. Each segment of the cathode terminal is connected by a line of conductive material to the edge of the glass layer for connection to the electrically conductive connector pins 40. A trimmed dielectric layer is placed over the cathode layer to cover up these connections.

On the second layer of glass 26, the anode layer is screened. The anode 36 is transparent so that the glow of the cathode may be seen. Preferably, a thin layer of tin oxide is used for the anode 36. The anode layer extends to the edge of the display for making connection with the pins 40. The connections for the heater strip 20, cathode 34 and anode 36 are all preferably along the same edge of the unit.

A capsule 44 containing mercury is placed within a glass funnel 46. The funnel 46 is cemented over the hole 42 at the rear of the first layer of glass 24. The mercury will be released later in the process. Solder glass is used to form the seal between the funnel and the glass. The two layers of glass 24, 26 are sealed together about the edge of the display. Solder glass is also used to form this seal. Small beads of glass are sprinkled around the seal to maintain a separation between the layers of glass of about 20 thousandths of an inch. A vacuum is attached through the funnel to the chamber 28 between the layers of glass. The pressure within the chamber 28 is reduced to $10^{-6}$ atmospheres. Then, $\frac{1}{3}$ of an atmosphere of gas is injected through the funnel 46. Preferably, the composition of the gas includes $99\frac{1}{2}$ percent neon and $\frac{1}{2}$ percent argon. The funnel 46 is sealed so that there is now no escape for the contents of the chamber 28. A laser is then directed at the capsule 44 containing the mercury. The laser causes the capsule 44 to break open and release the mercury into the sealed chamber 28.

Electrically conductive pins 40 are attached to the terminal connections for the cathode 34, anode 36 and heater strip 20 along the edge of the layers of glass. The preferred pins 40 are aligned in parallel and come in sets attached to a ribbon. These pins 40 are made of tin plated phosphor bronze. The pins 40 for a single display unit are inserted at the same time. The ribbon is removed and the pins 40 are epoxied in place, completing the manufacture of the unit.

In operating the gas discharge display, it is desirable that in cold weather a warm-up period precede the start up of the display. To ensure proper heating, a thermostat control can be used in conjunction with the heater. A thermostat sensor may be placed near the display unit to provide temperature information to the electronic control. The preferred embodiment of the present invention is made with a heater strip which has a resistance value of 35 ohms. A 24 volt AC current is applied to the heater strip to produce heat. By limiting the resistance of the heater strip, the wattage delivered to the strip can be limited, thereby preventing a maximum temperature from being exceeded. The preferred embodiment is limited to about 125° F. The resistance of the heater strip may be changed to accommodate the variety of applications of the present invention.

Of course, it should be understood that various changes and modifications to the preferred embodiment described above will be apparent to those skilled in the art. For example, a variety of configurations for the heater strip and the cathode display terminal are possible. These and other changes can be made without departing from the spirit and scope of the invention without diminishing its attendant advantages. It is therefore intended that such changes and modifications be covered by the following claims.

I claim:

1. In a gas discharge display device having a cathode terminal and an anode terminal separated from each other within a sealed gas chamber formed between two layers of glass, the gas in the chamber including a mixture of inert gases and mercury at subatmospheric pressure, the improvement comprising:

heater means on one of said layers of glass positioned proximate the cathode terminal and within the display device for maintaining an internal device temperature of at least 0° C. so that mercury is maintained in a gaseous state within the device; and insulating means overlying said heater means for electrically insulating said heater means from said cathode and anode terminals to facilitate the conduction of heat from the heater means to the gas in said chamber, and for electrically insulating said heater means from the gas in said chamber so that the heater means does not affect the light discharge between said anode and cathode terminals.

2. The gas discharge display device of claim 1 further comprising, a plurality of electrically conductive connectors, extending in parallel from one edge of said unit, to provide an electrical connection for said cathode, said anode and said heater means.

3. The gas discharge display device of claim 1 further comprising, two layers of glass sealed together to form the gas chamber, said heater means being located between said layers of glass.

4. An improved gas discharge display device comprising:

a sealed chamber formed between two layers of glass containing a mixture of inert gases and mercury at a subatmospheric pressure;

a cathode terminal at one side of said chamber shaped to include means for displaying alpha-numeric images;

an anode terminal located at the opposite side of said chamber from said cathode terminal;

a heater strip positioned on one of said layers of glass proximate said cathode terminal within said display for maintaining an internal temperature of at least 0° C. for external ambient temperatures less than 0° C., so that mercury within the display is maintained in a gaseous state;

insulating means overlying said heater strip for electrically insulating said heater strip from said terminals to facilitate the conduction of heat from said heater strip to the gas in said chamber, and for electrically insulating said heater strip from the gas in said chamber so that said heater strip does not affect the light discharge between said anode terminal and said cathode terminal; and means for providing an electrical connection to said cathode and anode terminals and said heater strip.

5. The gas discharge display device of claim 4 wherein said means for providing an electrical connection comprises a plurality of electrically conductive pins extending in parallel from one edge of said unit.

6. An improved gas discharge display device comprising:

a first layer of glass;

a heater strip screened on said first layer of glass;

a dielectric insulating layer overlying said heater strip on said first layer of glass;

a cathode screened onto said dielectric layer in a shape providing means for displaying alphanumeric images;

a second layer of glass;

an anode screened on said second layer of glass; and means for sealing said first layer of glass to said second layer of glass so that said cathode and said anode are positioned opposite each other in a subatmospheric pressure chamber containing a mixture of inert gases and mercury, said mercury being maintained in a gaseous state by said heater.

7. The gas discharge display device of claim 6 further comprising, a plurality of electrically conductive connectors, extending in parallel from one edge of said unit, to provide an electrical connection for said cathode, said anode and said heater strip.

* * * * *